US005735473A

United States Patent [19]

Hermanns et al.

[11] Patent Number: 5,735,473

[45] Date of Patent: Apr. 7, 1998

[54] METHOD AND APPARATUS FOR AVOIDING RIBBON WINDINGS

[75] Inventors: Ferdinand-Josef Hermanns, Erkelenz; Ralf Hoffmann, Mönchengladbach, both of Germany

[73] Assignee: W. Schlafhorst AG & Co., Moenchengladbach, Germany

[21] Appl. No.: 866,507

[22] Filed: May 30, 1997

Related U.S. Application Data

[63] Continuation of Ser. No. 766,927, Dec. 16, 1996, abandoned, which is a continuation of Ser. No. 496,330, Jun. 29, 1995, abandoned.

[30] Foreign Application Priority Data

| | | | |
|---|---|---|---|
| Jun. 29, 1994 | [DE] | Germany | 44 22 711.6 |
| May 27, 1995 | [DE] | Germany | 195 19 542.6 |

[51] Int. Cl.[6] ..... B65H 54/14

[52] U.S. Cl. ..... 242/18.1; 242/18 DD

[58] Field of Search ..... 242/18.1, 18 DD

[56] References Cited

U.S. PATENT DOCUMENTS

| | | | |
|---|---|---|---|
| 4,296,889 | 10/1981 | Martens | 242/18.1 |
| 4,325,517 | 4/1982 | Schippers et al. | 242/18.1 |
| 4,377,263 | 3/1983 | Guelpa | 242/18.1 |
| 4,696,435 | 9/1987 | Hermanns | 242/18.1 |
| 4,798,347 | 1/1989 | Schippers et al. | 242/18.1 X |
| 4,805,844 | 2/1989 | Hermanns et al. | 242/18.1 X |
| 4,828,191 | 5/1989 | Ruge et al. | 242/18 DD X |
| 4,986,483 | 1/1991 | Ryu et al. | 242/18.1 X |
| 5,035,370 | 7/1991 | Hermanns | 242/18.1 |

FOREIGN PATENT DOCUMENTS

| | | |
|---|---|---|
| 2914924 | 10/1980 | Germany . |
| 3521152 | 12/1986 | Germany . |
| 3703869 | 8/1988 | Germany . |
| 3916918 | 11/1990 | Germany . |
| 3927142 | 2/1991 | Germany . |

*Primary Examiner*—Michael Mansen

*Attorney, Agent, or Firm*—Herbert L. Lerner; Laurence A. Greenberg

[57] ABSTRACT

A method for avoiding ribbon windings in the winding of a cross-wound bobbin or cheese includes driving the cheese with a drive drum having reversing thread grooves for yarn guidance. A circumferential speed of the drive drum is continuously varied. The cheese is accelerated with the drive drum so that the cheese follows a course of motion of the drive drum with slip. A rotary speed of a drive motor is monitored with a winding station computer. The drive drum is driven with the motor acting as a moment adjuster in terms of control technology. A command value specification of a current is fed to a current regulator through the winding station computer for accelerating the drive drum with a constant preselectable moment and for braking the drive drum with another constant preselectable moment, for generating the slip between the cheese and the drive drum being varied for preventing a match in a rotary speed ratio between the drive drum and the cheese that causes ribbon windings. An apparatus for winding cross-wound bobbins or cheeses includes a drive drum acting as a drive mechanism for cheeses and having reversing thread grooves for yarn guidance and for laying a yarn. A drive motor drives the drive drum and acts as a moment adjuster in terms of regulating technology. A winding station computer is connected to the drive motor for monitoring a rotary speed of the drive motor.

9 Claims, 5 Drawing Sheets

METHOD AND APPARATUS FOR AVOIDING RIBBON WINDINGS

This application is a continuation of application Ser. No. 08/766,927, filed Dec. 16, 1996, now abandoned which was a continuation of application Ser. No. 08/496,330, filed Jun. 29, 1995 now abandoned.

BACKGROUND OF THE INVENTION

FIELD OF THE INVENTION

The present invention relates to a method for avoiding ribbon windings in the winding of a cross-wound bobbin or cheese which is driven by a drive drum having reversing thread grooves for yarn guidance, wherein the circumferential speed thereof is varied continuously and the cheese is accelerated by the drive drum in such a way that the cheese follows a course of motion of the drive drum with slip, and a winding station computer monitors the rotary speed of the drive motor of the drive drum. The invention also relates to an apparatus for performing the method.

During the winding of cross-wound bobbins or cheeses, there is a danger that in certain diameter ranges of the cheese at certain rpm ratios between the drive drum of the cheese and the cheese itself, so-called ribbon windings will occur as the yarn is deposited on the cheese. In other words, during a relatively large number of revolutions, the yarn is always deposited within a narrow range over the periphery of the cheese, which has a very strongly negative effect on performance when a cheese is unwound. German Published, Non-Prosecuted Application DE 37 03 869 A1, corresponding to U.S. Patent No. 5,805,844, for instance, discloses a method and an apparatus for avoiding ribbon windings. In order to avoid ribbon windings, an intermittent slip between the drive drum and the cheese is generated. The drum rpm is initially raised to a predetermined value. Once the drum rpm has reached its predetermined value, the drive is shut off, and the cheese and the drive drum slow down until they reach a predetermined lower rpm. However, that slowing down is dependent on mechanical conditions, such as bearing friction and the mass of the bobbin. The slowing down performance is determined substantially by the inner mass of the system and the existing load moment. Deviations from electrical or mechanical parameters also change the ribbon-breaking effect, or in other words, the ribbon-breaking cycles are not constant.

German Published, Non-Prosecuted Application DE 39 16 918 A1, corresponding to U.S. Pat. No. 5,035,370, also discloses a method and an apparatus for avoiding ribbon windings. The drive drum of the cheese is both accelerated and braked by its drive in accordance with a predeterminable periodic function in such a way that the cheese follows the course of motion of the drive drum in a permanently phase-offset manner, or in other words with slip. The amplitude or frequency of the periodic function is varied depending on the increasing diameter of the cheese during the bobbin travel.

In accordance with that known method, a rotary speed regulation of the drive drum takes place between a minimum and a maximum rpm. The predetermined periodicity of the rpm fluctuations of the drive motor determines the ribbon-breaking effect. However, for the same slip in the acceleration and braking phase of the cheese, the danger exists of parallel layers of windings being deposited one on top of the other on the cheese.

SUMMARY OF THE INVENTION

It is accordingly an object of the invention to provide a method and an apparatus for avoiding ribbon windings, which overcome the hereinafore-mentioned disadvantages of the heretofore-known methods and devices of this general type and which further improve the ribbon-breaking effect of the known method as applied to the avoidance of ribbon windings.

With the foregoing and other objects in view there is provided, in accordance with the invention, in a method for avoiding ribbon windings in the winding of a cross-wound bobbin or cheese, which includes driving the cheese with a drive drum having reversing thread grooves for yarn guidance, continuously varying a circumferential speed of the drive drum, accelerating the cheese with the drive drum so that the cheese follows a course of motion of the drive drum with slip, and monitoring a rotary speed of a drive motor for the drive drum with a winding station computer, the improvement which comprises driving the drive drum with the motor acting as a moment adjuster in terms of control technology, feeding a command value specification of a current to a current regulator through the winding station computer for accelerating the drive drum with a constant preselectable moment and for braking the drive drum with another constant preselectable moment, for generating the slip between the cheese and the drive drum being varied for preventing a match in a rotary speed ratio between the drive drum and the cheese that causes ribbon windings.

With the objects of the invention in view, there is also provided an apparatus for winding cross-wound bobbins or cheeses, comprising a drive drum acting as a drive mechanism for cheeses and having reversing thread grooves for yarn guidance and for laying a yarn; a drive motor for driving the drive drum, the drive motor acting as a moment adjuster in terms of regulating technology; and a winding station computer connected to the drive motor for monitoring a rotary speed of the drive motor.

The drive drum is driven by a motor that acts as a moment adjuster from a regulation standpoint. This may be an electronically commutated three-phase synchronous motor. The advantage of such a motor is its performance from a regulation standpoint as a so-called "pure moment adjuster". As a result, according to the invention, the moments of acceleration and braking of the drive drum are adjustable. The slip that arises between the drum and the bobbin is not dependent on the operating point of the motor, which leads to a better-controlled ribbon-breaking effect. The moment specification determines the slip that occurs.

The command value specification of the current for the current adjuster of the motor is carried out from the winding station computer. The instantaneous operating point of the motor is known from the current specification. As a function of this operating point and of the parameters of the cheese that cause the ribbon windings, such as the diameter and weight of the cheese, the length of yarn already wound on, and the circumferential speed of the cheese, a current specification is made in such a way that the motor undergoes a positive or negative acceleration that is adapted to the course of the rotary speed. As a result, the cheese follows the drive drum with a controlled slip that effectively breaks up the ribbon windings. In other words, the winding station computer specifies a command or set-point current value to the current regulator of the motor, that is the end stage, and this current is directly proportional to the torque output, so that the term moment specification can also be used.

Advantageously, this offers the possibility of exerting influence upon the winding process. According to the invention, the command value specification of the current to the current regulator by the winding station computer is performed in such a way that the drive drum is accelerated with a constant, preselectable moment and braked with another constant, preselectable moment. In the current specification, and in accordance with its operating program, the winding station computer takes into account all of the parameters which are relevant to the winding process, such as the bobbin mass, the contact pressure of the bobbin, the bobbin diameter and the coefficient of friction of the yarn.

Heretofore the braking performance of the system was determined by the inertia of the mass and the existing load moment, but it is now possible according to the invention, in the braking phase, to generate a torque that is counter to the load moment and that more or less cancels out the load moment in controlled fashion. The braking phase can be strongly influenced as a result.

According to the invention, it is possible in the braking phase to reduce the slip between the drive drum and the cheese to the physically attainable minimum and nevertheless to compel the cheese to perform with a preselected braking. This minimum slip is practically nonexistent, in proportion to the slip in the acceleration phase. In order to achieve this state, the value for the deceleration, which is constant in the braking phase, must not exceed a limit value beyond which a perceptible slip occurs. However, the slope angle of the deceleration cannot be varied away from the limit value, without changing something of the (nonexistent) slip. The limit value is dependent on various influential factors, such as the coefficient of friction of the yarn to be rewound, the contact pressure of the bobbin on the drive drum, and the inertia of the bobbin, which is dictated by the fullness of the bobbin. With the aid of the invention, it is possible to select the respective length of the acceleration and braking phases, the period length, and the amplitudes about a mean circumferential speed of the drive drum during bobbin travel, within wide limits, and thereby to optimize the ribbon breaking.

Other features which are considered as characteristic for the invention are set forth in the appended claims.

Although the invention is illustrated and described herein as embodied in a method and an apparatus for avoiding ribbon windings, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings;.

DESCRIPTION OF THE PREFERRED EMBODIMENTS

Figure 1:
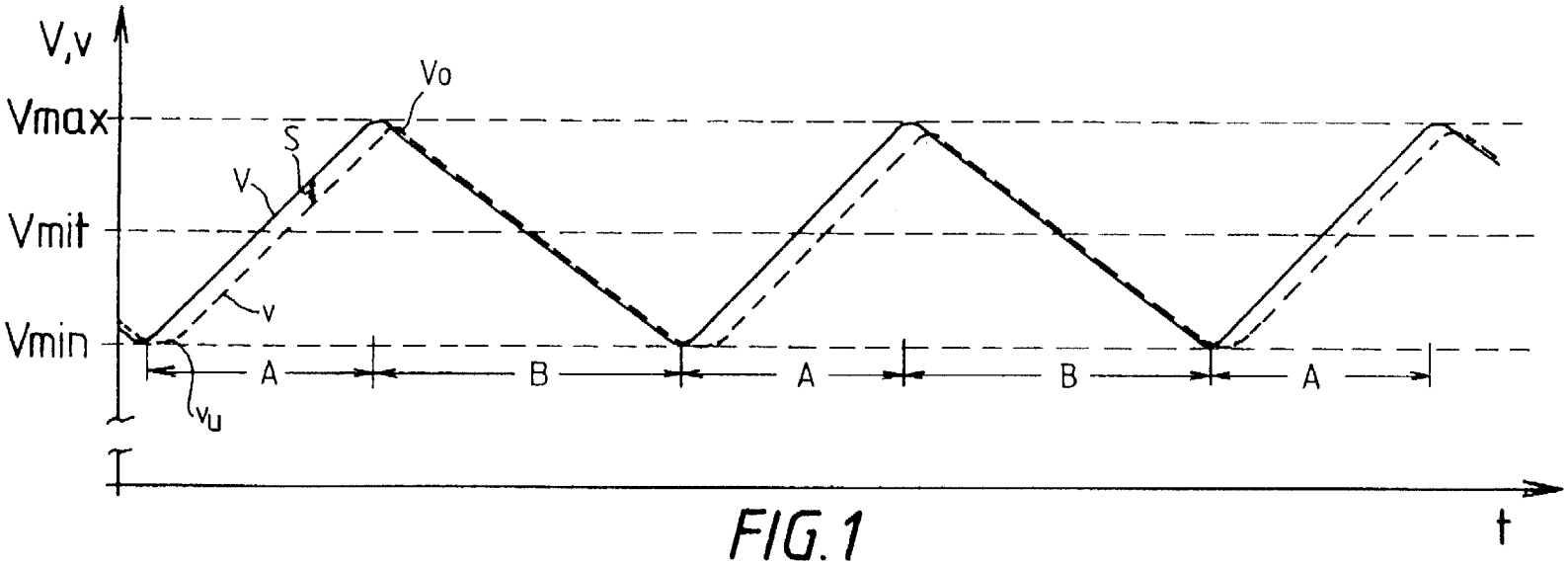
FIG. 1 is a time and speed diagram with a constant period and amplitude, in which an acceleration phase is shorter than a braking phase.

Referring now to the figures of the drawing in detail and first, particularly, to FIG. 1 thereof, there is seen a time and speed diagram in which courses of a circumferential speed V of a drive drum and v of a cheese are shown. The circumferential speed V of the drive drum fluctuates with the same amplitude about a mean circumferential speed Vmit, between a maximum circumferential speed Vmax and a minimum circumferential speed Vmin.

The drive drum is accelerated out of a lower turning point at the speed Vmin at a constant moment through the use of a moment specification in an acceleration phase A. With a short delay, the cheese follows the drive drum from a turning point at which it reached a circumferential speed $v_u$. The cheese attempts to follow the drive drum with the same speed, but because of its inertia a speed difference remains between the circumferential speed V of the drive drum and the circumferential speed v of the cheese. This difference is called a slip S. This slip varies with the changing speed of the drive drum. While the drive drum has already exceeded the maximum speed Vmax, after a corresponding delay an upper turning point at a speed $v_o$ of the cheeses follows, beyond which point the speed of the cheese likewise drops as the rpm of the drive drum drops.

Once the circumferential speed of the drive drum reaches the upper limit Vmax, a different, constant braking moment is imposed. Through a selection of the braking moment, influence can be exerted on the slowing down performance of the cheese through the use of the drive drum. As indicated, in this case the cheese follows the drive drum with an almost imperceptible slip. In order to provide better clarity of the curve courses, the slip in a braking phase B, which is in the region of zero, is shown in an exaggerated manner. The danger of parallel windings on top of one another as a result of symmetrical slipping is thus reliably avoided.

It must be taken into account in this respect above all that when the slip is approximately the same in both the acceleration and the braking phase, the speed ratio of the drive drum and the bobbin "fluctuates" about a mean value in such a way that ribbon windings cannot be adequately suppressed. In contrast to this, with different slips in the acceleration and braking phases, the advantage is that this critical speed ratio is practically always shifted farther out past the ribbon winding zone.

In the braking phases the slip is negligibly low, and the speed ratio between the drive drum and the cheese does not change. In this period of time, the actual circumferential speed of the cheese, from which the cheese diameter can be calculated, can be determined. The cheese diameter can also be ascertained by some other method on the basis of the angular position of the creel as compared with its basic position.

Figure 2:
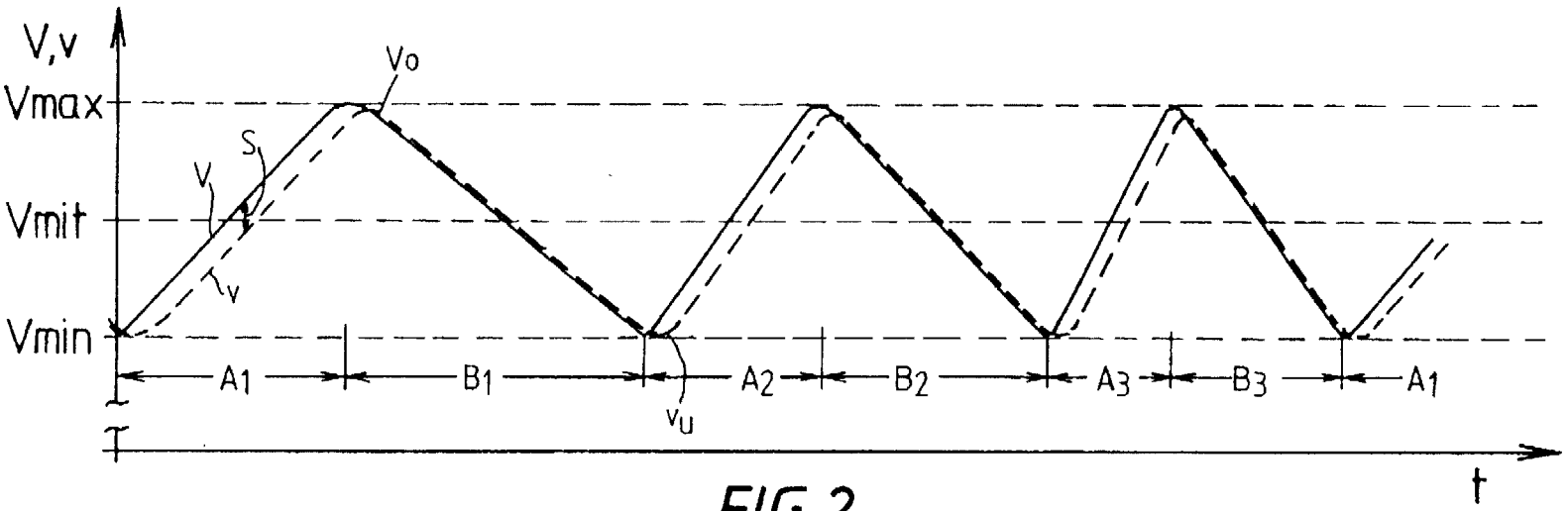
FIG. 2 is a time and speed diagram with a constant amplitude and varying slope angles both in the acceleration and the braking phases.

FIG. 2 shows a time and speed diagram in which successive acceleration and braking phases are each of a different length, and one cycle each having three successive acceleration and braking phases recurs. The successive acceleration phases $A_1$, $A_2$ and $A_3$ become shorter, as do the braking phases $B_1$–$B_3$. After the braking phase $B_3$, the cycle begins again, as is indicated by an incipient acceleration phase $A_1$.

Figure 3:
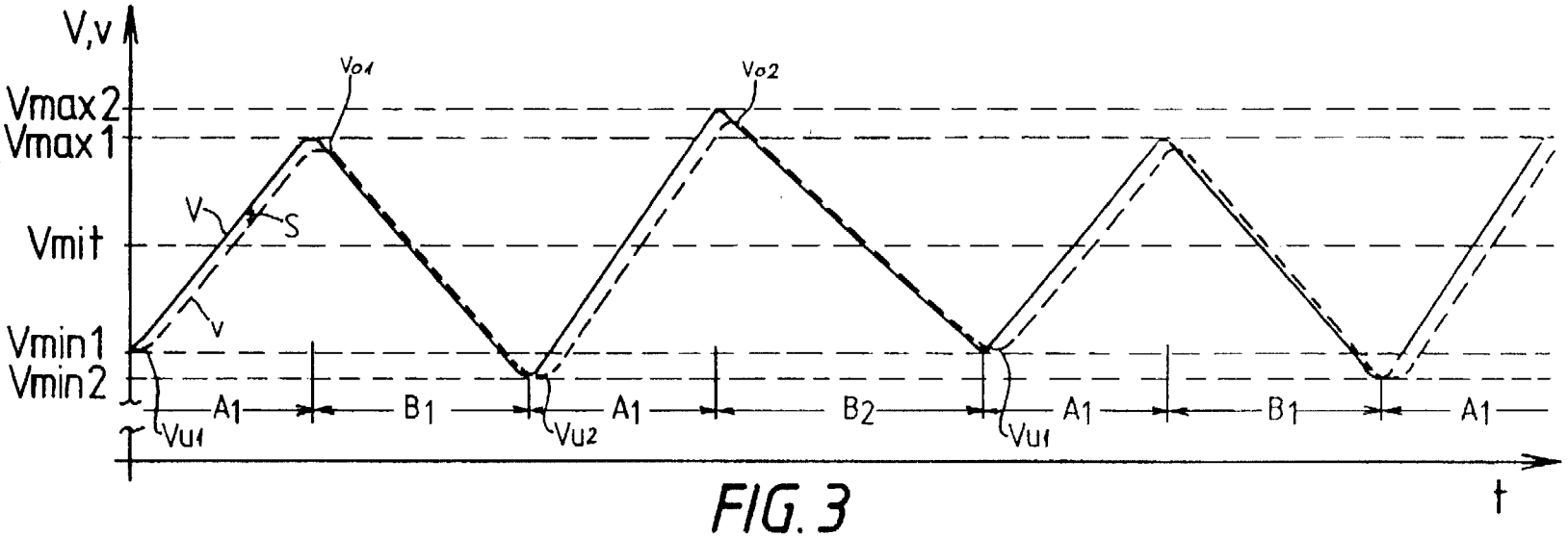
FIG. 3 is a time and speed diagram with varying amplitude and varying slope angles both in the acceleration and the braking phases in chronological succession.

FIG. 3 shows a time and speed diagram in which not only are the successive acceleration and braking phases of different lengths, but the amplitudes of the circumferential speed of the drive drum oscillate about the mean circumferential speed Vmit, which alternates between two limit values of different amplitudes. In the acceleration phase $A_1$, the cheese is accelerated from a lower turning point at a speed $v_{u1}$ to an upper turning point at a speed $v_{o1}$. The rotary speed of the drive drum rises from $Vmin_1$ to $Vmax_1$ in the process. In the first braking phase $B_1$, through the use of a preselected moment, the cheese is braked to a circumferential speed $V_{u2}$, which is below the speed $V_{u1}$. The rotary speed of the drive drum drops as far as $Vmin_2$. The next acceleration phase $A_1$ is the same length as the previous one, but the cheese is accelerated to a circumferential speed $v_{o2}$, and the drive drum reaches the circumferential speed $Vmax_2$. The braking phase $B_2$ is longer than the preceding one, and the cheese is again braked to a speed that is located at the lower turning point having the speed $v_{u1}$. As a result of the braking moment, the drive drum reaches the circumferential speed $Vmin_1$. The braking and acceleration cycle described above then begins over again.

Figure 4:
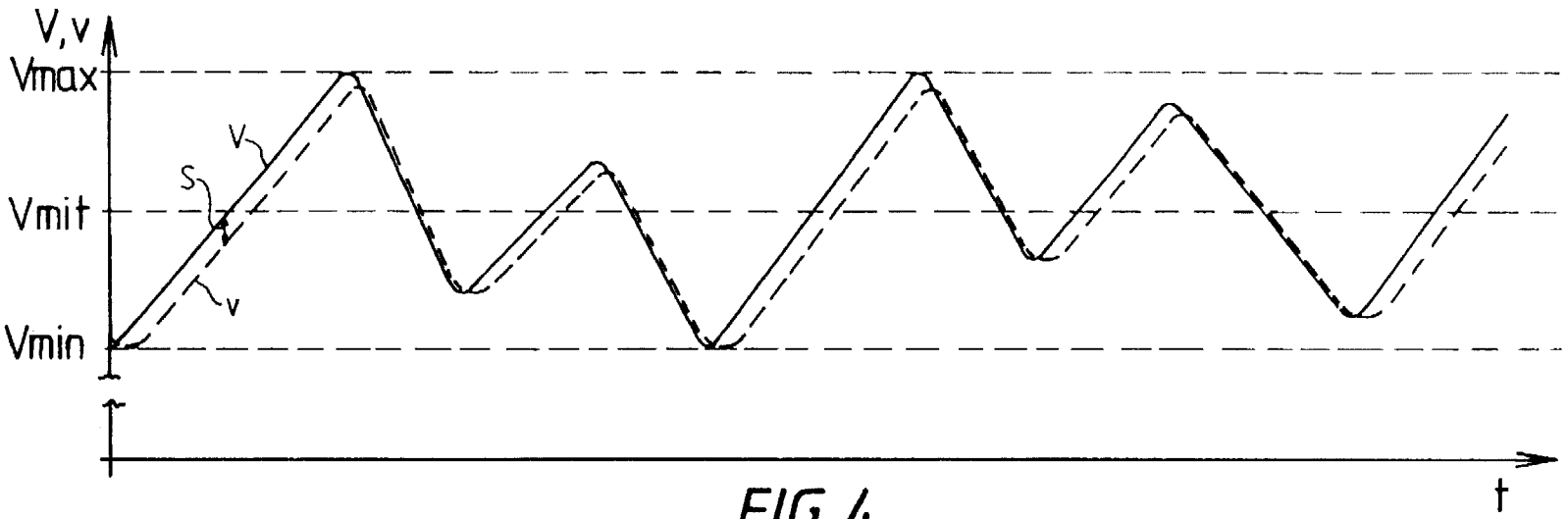
FIG. 4 is a time and speed diagram with periodicity changes generated by a random generator.

FIG. 4 shows a time and speed diagram in which a command value specification of a current for a current transducer is carried out through the use of a random generator in such a way that the mean circumferential speed of the drive drum fluctuates between two limit values, Vmax and Vmin, but any amplitude is possible. The braking and acceleration phases are also arbitrary.

The four diagrams show a choice of possibilities for a way in which ribbon windings can be avoided by purposeful interventions into the winding of cheeses. Through the use of a suitable command value specification of the current to the current regulator, the drive drum can be accelerated with an arbitrary, constant, preselectable moment and braked with an another arbitrary, constant, preselectable moment, as the diagrams show.

Figure 5:
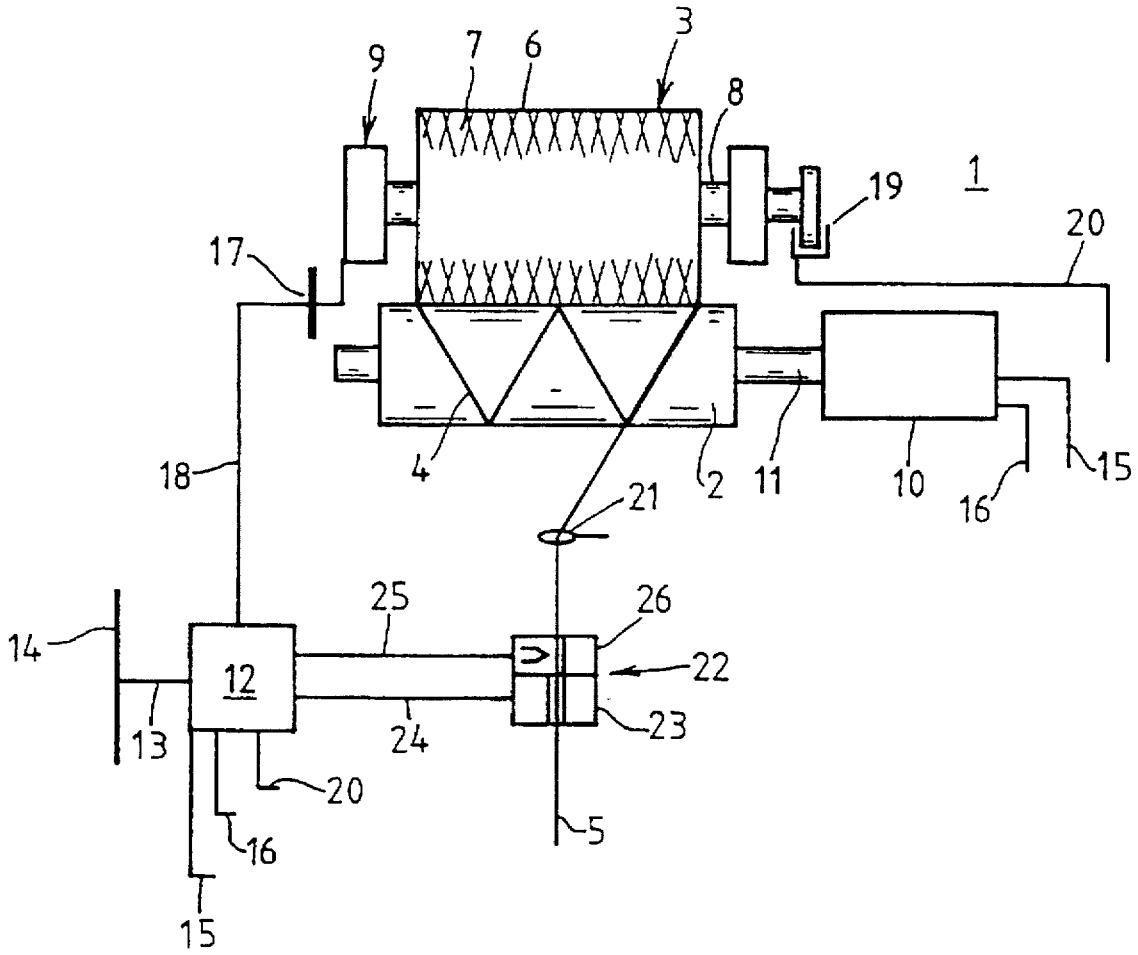
FIG. 5 is a schematic and diagrammatic view of a bobbin winder.

FIG. 5 schematically and diagrammatically shows the known layout of a bobbin winder at a winding station 1 of a bobbin winding machine, which is not shown in further detail. At the winding station 1, a cheese or cross-wound bobbin 3 rests on a drive drum 2, which is a winding roller. The drive drum is a winding roller having a groove 4 with which a yarn 5 arriving from a non-illustrated feed bobbin is deposited in cross-wound layers 7 onto a peripheral surface 6 of the cheese 3. A tube 8 of the cheese 3 is held in a creel 9. The drive drum 2 is driven by an electronically commutated three-phase synchronous motor 10. The drive drum 2 is seated directly on a lengthened rotor shaft 11 of the motor 10.

In order to control the winding station, a control unit 12 is provided, which is connected through a connection 13 to a data bus 14, to which all of the non-illustrated winding station computers are connected and which leads to an overriding central control unit of the bobbin winding machine, that is to a non-illustrated winding station computer. The motor 10 for driving the drive drum 2 is connected through a control line 15 to the control unit 12 for specifying the command or set-point current value. The actual speed can be imparted through a signal line 16 to the winding station computer by sampling of a signal transducer, such as a pole wheel, in the motor. Reference numeral 12 will be used below to represent the control unit and the winding station computer as a whole.

Other signal transducers, such as a signal transducer 17, with which the position of the creel 9 can be ascertained as the diameter of the cheese 3 increases, are connected to the winding station computer 12. By way of example, this signal transducer may be a potentiometer. The signal transducer 17 is connected through a signal line 18 to the winding station computer 12. A further signal transducer 19 is used to ascertain the actual bobbin rpm. By way of example, the signal transducer 19 may be a pole wheel, having a signal train from which a conclusion can be drawn as to the number of revolutions during a unit of time. This signal transducer is connected to the winding station computer 12 over a signal line 20.

Before the yarn 5 passes through a yarn guide eyelet 21 to reach the drive drum or winding roller 2, it passes through a so-called cleaner 22. Through the use of a sensor 23, the yarn quality is monitored, and signals are carried to the winding station computer 12 over a signal line 24. If the ascertained yarn quality deviates from a predetermined standard, then a cutting device 26 is actuated over a signal line 25, so that in an ensuing operation, which is not described in this case but is known from the prior art, the flaw is cut out of a length of yarn drawn from the cheese.

Figure 6:
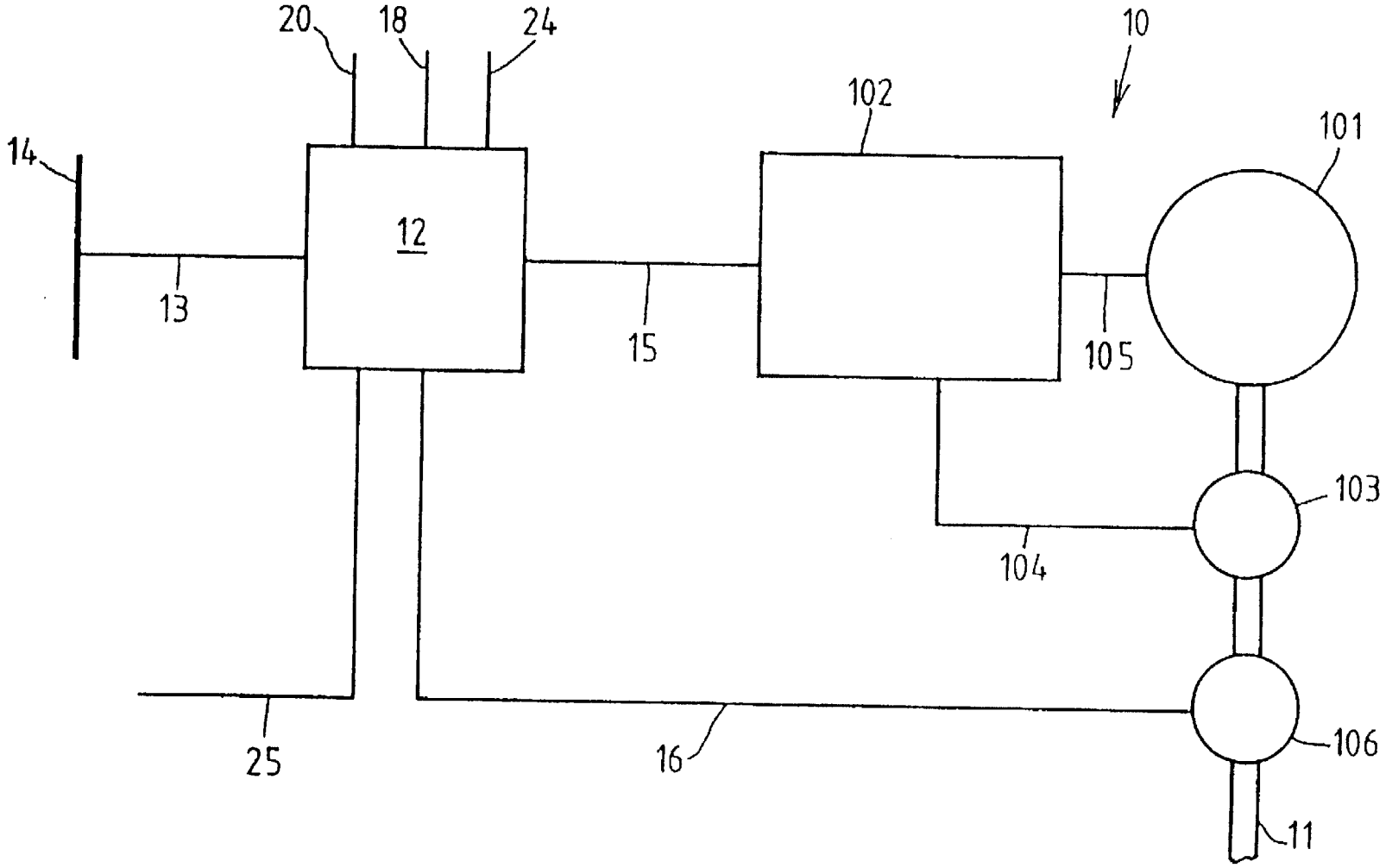
FIG. 6 is a block circuit diagram of a motor drive mechanism with sensor monitoring of a drive drum position.

FIG. 6 shows a block circuit diagram of a drive of the motor 10 of the drive drum 2. In the electronically commutated three-phase synchronous motor 10, an actual motor drive 101 precedes a current regulator or so-called end stage 102. The winding speed is specified over the bus 14 to the winding station computer 12 by the non-illustrated overriding control unit of the machine. This computer thereupon issues a signal over the signal line 15 to the current regulator 102, for adjusting the command or set-point current value. As a result of the feedback reports of the rotor position through the rotor position transducer, a triggering of the corresponding stator windings by the end stage takes place. A rotor position transducer 103 is seated on the motor shaft 11 having the extension on which the drive drum 2 is also seated. The rotor position transducer 103 may include Hall sensors. The signals of the rotor position transducer are reported to the current regulator 102 over a signal line 104, and the current regulator thereupon triggers the individual stator windings over a signal line 105.

In order to enable the actual motor rpm and thus the actual speed of the drive drum 2 to be ascertained, there is an rpm meter 106, such as a pole ring, seated on the motor shaft 11. It is scanned, and its signals are carried over the signal line 16 to the control unit of the winding station computer for specifying the command current value.

Figure 7:
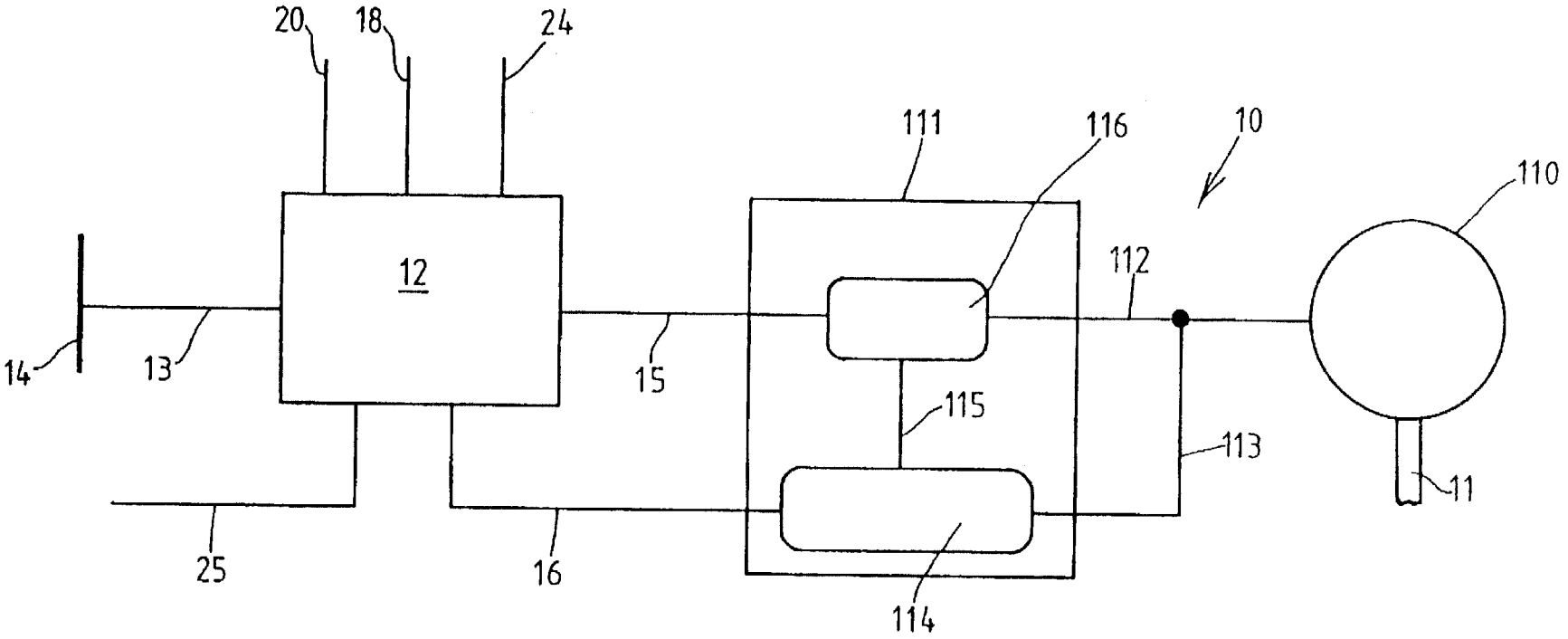
FIG. 7 is a block circuit diagram of a motor drive mechanism with detection of a rotor position through the use of a rotor-induced voltage.

FIG. 7 shows the circuit diagram of an electronically commutated three-phase synchronous motor 10, in which the commutation of a drive part 110 takes place with the aid of the monitoring of the course of voltage induced in the windings that just then do not have current flowing through them.

While the winding station computer 12 specifies a command or set-point rpm value to a so-called end stage 111 over the signal line 15, and the end stage 111 in turn controls the distribution of current (116) to the various stator windings over a signal line 112, a feedback of the induced course of voltage in the stator windings that just then do not have current flowing through them takes place over a signal line 113. Through the use of this feedback, which is effected over the signal line 113 to a microprocessor 114, for instance, which is within the end stage 111, the rotor position is ascertained and thus the requisite distribution of the current to the various stator windings is ascertained. Through the use of the microprocessor 114, the rpm of the motor can thus simultaneously be ascertained and imparted over the signal line 16 to the control unit of the winding station computer. The distribution of the current to the various stator windings is also controlled through a signal line 115.

We claim:

1. In a method for avoiding ribbon windings in the winding of a cross-wound bobbin or cheese, which includes driving the cheese with a drive drum having reversing thread grooves for yarn guidance, continuously varying a circumferential speed of the drive drum, accelerating the cheese with the drive drum so that the cheese follows a course of motion of the drive drum with slip, and monitoring a rotary speed of a drive motor for the drive drum with a winding station computer, the improvement which comprises:

defining, with a winding station computer, a torque required for driving the drive drum with the drive motor such that the slip between the drive drum and the cheese is varied;

feeding a command value specification of a current to a current regulator of the drive motor through the winding station computer for adjusting a torque output of the drive drum to the torque defined in the defining step, and accelerating the drive drum with a constant torque and braking the drive drum with another constant torque, and consequently preventing a rotary speed of the drive drum and a rotary speed of the cheese to assume a relationship that causes ribbon windings.

2. The method according to claim 1, which comprises selecting the braking moment for causing the cheese to revolve with the drive drum at least approximately without slip.

3. The method according to claim 1, which comprises driving the drive drum with an electronically commutated three-phase synchronous motor.

4. The method according to claim 1, which comprises, prior to the feeding step, predetermining with the winding station computer a time necessary for an acceleration phase and a time necessary for a braking phase, and, as a function of upper and lower limit values of the winding speeds, calculating a slope angle for the acceleration and the braking, and, in the feeding step, feeding the command value specification of the current for accelerating and braking the drive drum.

5. The method according to claim 4, which comprises continuously measuring and setting the rotary speed of the cheese and the rotary speed of the drive drum in proportion to one another with the winding station computer, determining a cheese diameter during the braking step, and wherein the feeding step is performed during the acceleration and braking steps.

6. An apparatus for winding cross-wound bobbins or cheeses, comprising:

a support for cheeses;

a drive drum disposed in vicinity of said support, said drive drum acting as a drive mechanism for the cheeses and having reversing thread grooves for yarn guidance and for laying a yarn;

a drive motor for driving said drive drum at an adjustable torque output; and a winding station computer connected to said drive motor for monitoring and regulating said adjustable torque output of said drive motor, said drive motor being connected to receive from said winding station computer a current signal adjusted to cause a slip between said drive drum and said cheeses during an acceleration phase and adjusted to provide a constant torque during said acceleration phase in which said motor accelerates said drive drum towards an upper rotary speed.

7. The apparatus according to claim 6, wherein said drive motor of said drive drum is an electronically commutated three-phase synchronous motor, and said drive motor has a current regulator being operatively connected to said winding station computer for specifying current command values and for regulating a rotary speed of said drive drum.

8. The apparatus according to claim 7, including sensors for measuring current data of a cheese being produced, said sensors communicating with said winding station computer for processing measured values and for influencing the current command value specification being fed to said current regulator.

9. An improved method for avoiding ribbon windings in the winding of a cross-wound bobbin or a cheese, which includes driving the cheese with a drive drum having reversing thread grooves for yarn guidance, continuously varying a circumferential speed of the drive drum, accelerating the cheese with the drive drum so that the cheese follows a course of motion of the drive drum with slip, and monitoring a rotary speed of a drive motor for the drive drum with a winding station computer, the improvement which comprises:

preventing a match in a rotary speed ratio between the drive drum and the cheese that causes ribbon windings, by driving the drive drum with the motor with a given torque;

feeding a command value specification of a current to a current regulator through the winding station computer, for accelerating the drive drum with a constant preselectable torque and for braking the drive drum with another constant preselectable torque, for varying the slip.

* * * * *